United States Patent [19]

Carrier

[11] 4,249,522

[45] Feb. 10, 1981

[54] HYDROMASSAGE APPARATUS

[75] Inventor: Roger Carrier, Ste-Foy, Canada

[73] Assignee: Bain Ultra Quebec Inc., Quebec, Canada

[21] Appl. No.: 50,040

[22] Filed: Jun. 19, 1979

[30] Foreign Application Priority Data

Jun. 20, 1978 [CA] Canada ..... 305870

[51] Int. Cl.[3] ..... A61H 9/00

[52] U.S. Cl. ..... 128/66; 4/543

[58] Field of Search ..... 128/66, 65; 4/180

[56] References Cited

U.S. PATENT DOCUMENTS

| | | | |
|---|---|---|---|
| 3,263,678 | 8/1966 | Everston | 128/66 |
| 3,374,492 | 3/1968 | Ruderian | 128/66 X |
| 3,377,630 | 4/1968 | Robare | 128/66 X |
| 3,420,226 | 1/1969 | Berry | 128/66 X |
| 3,797,482 | 3/1974 | Nicollet | 128/66 |
| 3,814,399 | 6/1974 | Melreit | 4/180 X |
| 3,964,472 | 6/1976 | Nicollet | 128/66 |
| 4,160,292 | 7/1979 | Kuether et al. | 4/180 |

*Primary Examiner*—Lawrence W. Trapp
*Attorney, Agent, or Firm*—Wolder, Gross, Yavner

[57] ABSTRACT

A hydromassage bathtub for domestic and therapeutic applications. The bathtub has a two level bottom wall defined by two successive surfaces sloping slightly towards the drain pipe area and joined to one another by a transverse ramp of slight extent, a front inclined wall having a centrally located depression facing the lower portion of the back of the user, an essentially vertical end wall opposite the inclined wall and two essentially vertically extending lateral walls. Longitudinal passages secured to the outside surface of the bathtub along the lower region thereof and extending essentially tangentially to the lateral walls, to the inclined wall and to the end wall, for circulating compressed air emanating from blowers. The compressed air is also distributed through inwardly extending branches connected to the lateral passages, the branches being located underneath the bathtub and following the transverse ramp. A plurality of apertures leading from the air distribution system to the inside of the bathtub distributed evenly around the periphery of the bathtub slightly above its bottom wall but in the area where the lateral walls, inclined wall and end wall merge into said bottom wall there being at least two apertures leading from the branches to the lower region of the transverse ramp and at least two apertures at spaced apart locations in the depression whereby air under pressure is injected inwardly and slightly upward from all sides into the body of water contained into the bathtub for producing the desired hydromassaging effect.

8 Claims, 7 Drawing Figures

HYDROMASSAGE APPARATUS

This invention relates to hydromassaging apparatus using jets of compressed air to agitate the body of water contained in the bathtub of such apparatus.

In prior air hydromassaging tubs the distribution of air is generally accomplished by means of removable air manifolds immersed into the body of water and having a suitable number of apertures for the compressed air provided from an outside source thereof. Examples of such removable devices for aerating water in bathtubs are found in the following United States Patents: U.S. Pat. No. 1,034,919 Leuschner dated Aug. 6, 1912; U.S. Pat. No. 1,699,198 Millmather issued Jan. 12, 1929; U.S. Pat. No. 1,896,938 Borosky dated Feb. 7, 1933; U.S. Pat. No. 2,793,640 Swartz dated May 28, 1957; U.S. Pat. No. 2,921,579 Monroe dated Jan. 19, 1960; U.S. Pat. No. 3,043,296 Gregory dated July 10, 1962; U.S. Pat. No. 3,267,936 Bradey dated Aug. 23, 1966; U.S. Pat. No. 3,373,740 Riepl Mar. 19, 1968; U.S. Pat. No. 3,417,747 Beger dated Dec. 24, 1968; U.S. Pat. No. 3,420,227 Voorlas Jan. 7,1969; U.S. Pat. No. 3,533,404 Labarber dated Oct. 13, 1970; U.S. Pat. No. 3,534,730 Jacuzzi dated Oct. 20, 1970; U.S. Pat. No. 3,683,899 La Barber Aug. 15, 1972; U.S. Pat. No. 3,710,786 Rico and Jaeger dated Jan. 16, 1963; and U.S. Pat. No. 3,750,656 Vaughan dated Aug. 7, 1973. All such prior devices present essentially the same basic inconveniences which explain their limited acceptance by the consumer namely the lack of comfort to the user on account of the presence of a relatively large ring resting on the bottom of the tub, the problem of storing such a relatively large device when not in use, and the obvious danger of electrocution on account of the fact that such devices must be connected to a source of electricity through an ordinary electrical cord which is not necessiraly properly grounded and which affords no guarantee that the electric plug will not be directly connected into an ungrounded two-terminal electrical outlet. Moreover, where such devices are connected to a domestic vacuum cleaner acting as air supply the air flowing into the bathtub is either at insufficient pressure or fed through an insufficient number of apertures to provide adequate agitation of the body of water.

Some of the above noted inconveniences have been overcome by using built-in air distribution channels formed in the bottom region of the bathtub, and examples of such prior devices will be found in U.S. Pat. Nos. 3,251,071 Wood dated May 17, 1976; 3,964,472 Nicollet dated June 22, 1976; and 4,000,528 Posnick dated Jan. 4, 1977. With the exception of the Posnick patent these prior systems require structural details which are so complex and extensive that the resulting hydromassaging apparatus can hardly be destined to general public use where cost, installation and maintenance are of major concern.

The relatively simple structure proposed by Posnick however presents the major inconvenience that the air distribution channels constitute inaccessible spaces where water necessarily accumulates resulting in a serious sanitary problem.

One object of the present invention is to provide a simple hydromassage tub capable of producing effective water agitation.

An other object of the present invention is to provide a therapeutic tub which is aesthetically acceptable, which presents no sanitary problem and which may be used as an ordinary bathtub when the air supply system is not in use.

It is a further object of this invention to provide a hydromassage tub which may be easily installed and which presents no danger of electrocution.

Yet an other object of the present invention is to provide an air distribution system in a hydromassage tub which comprises jets of air in areas adjacent the bottom of the back of the user and in areas located underneath the mid part of the legs of the user.

It is a further object of the present invention to provide a hydromassage tub wherein the jets of air are so located in order not to be obstructed by the presence of any part of the body of the user.

In accordance with this invention I have found that these objects may be attained by using a hydromassage apparatus which comprises a tub having a bottom wall made of two successive levels interconnected by an inclined ramp of slight extent and sloping slightly towards the deepest end of the tub where the drain is located, an inclined front wall having a shallow depression in the lower central region thereof, an end wall extending essentially vertically and two essentially vertical side walls, longitudinally extending air ducts secured to the outside surfaces of said lateral walls towards the lower edge thereof, a short distance above said bottom wall, along the outside surface of said inclined wall and along the outside surface of said end wall for distributing compressed air emanating from blower means. The compressed air is also circulated through inwardly directed central branches disposed along the outside surface of said transversed ramp. A plurality of identical apertures extend through said lateral walls, through said inclined front wall and through said transverse ramp thus allowing air circulating through said air ducts and branches to be injected inwardly into the body of water contained in said bathtub.

Other features of the present invention will now become apparent from the following specific description of the accompanying drawings which illustrate a preferred embodiment in accordance with this invention and wherein FIG. 1, is a plan view of a hydromassage tub;

Figure 1:
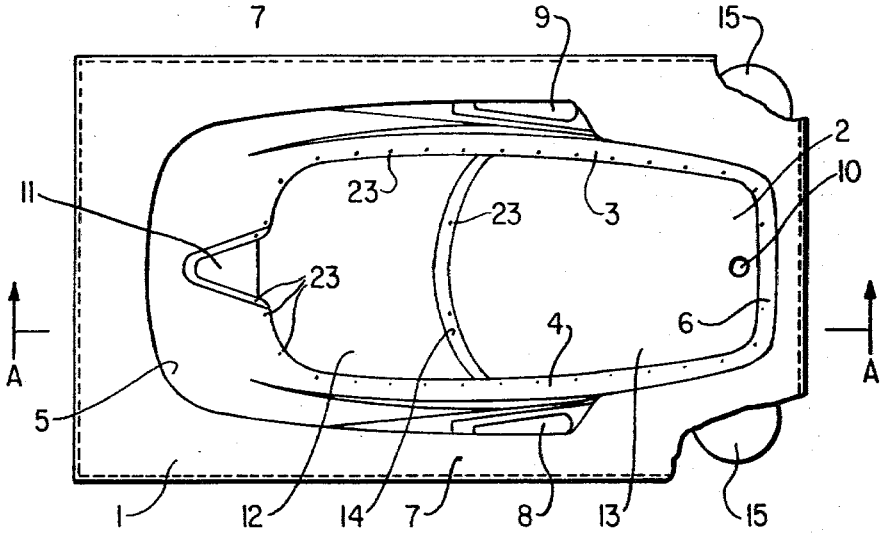

Referring now to the drawings, reference numeral 1 refers to a bathtub which has a bottom wall 2, essentially vertically extending lateral walls 3 and 4, an inclined front wall 5 and an essentially vertically extending end wall 6. An upper edge 7 extends around the periphery of the above noted four walls which merge into one another by rounded sections as in conventional bathtubs, and the flat surface 7 extends radially outwardly from the walls of the bathtub to define a convenient contour of desired configuration such as rectangular as shown in FIG. 1. Preferably bathtub 1 is molded of resin impregnated glass fiber.

Figure 3:
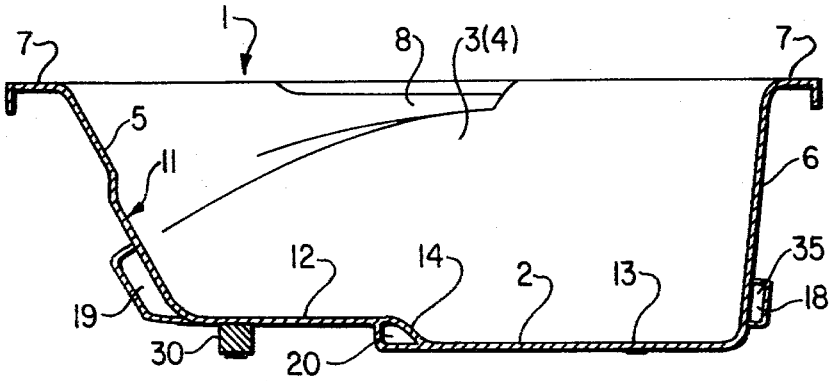
FIG. 3, is a longitudinal cross-sectional view taken along line A—A of FIG. 1.

Armrests 8 and 9 are provided in the upper regions of lateral walls 3 and 4 beginning adjacent flat surface 7 about mid-point along lateral surfaces 3 and 4 and sloping gradually towards inclined front wall 5. A drain pipe underneath stopper 10 is located adjacent the end wall 6 in the lowest region of bottom wall 2. Front inclined surface 5 is provided with a shallow depression 11 which, as seen in FIG. 1 is essentially triangular in configuration. Bottom wall 2 is made of two successive surfaces 12 and 13 sloping slightly towards the drain pipe and joined to one another by a transverse ramp 14 of slight extent; the upper level 12 of bottom wall 2 extends from the lower region of inclined front wall 5 generally to the center of bottom surface 2 whereas the lower level 13 of bottom wall 12 extends from ramp 14 to the vertical end wall 6 between lateral walls 3 and 4. The junction between bottom wall 2 and the surrounding upstanding walls 3, 4, 5 and 6 is defined by a peripheral curved surface of relatively small radius as in conventional bathtub design, and the transition between the upper level 12 and the lower level 13 of the floor 2 at the ramp 14 is equally smooth as best seen in FIG. 3.

Figure 2:
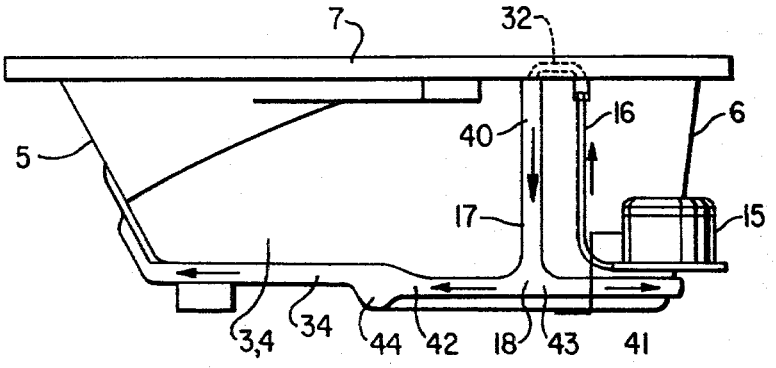
FIG. 2, is a elevational view of the hydromassage tub.
Figure 4:
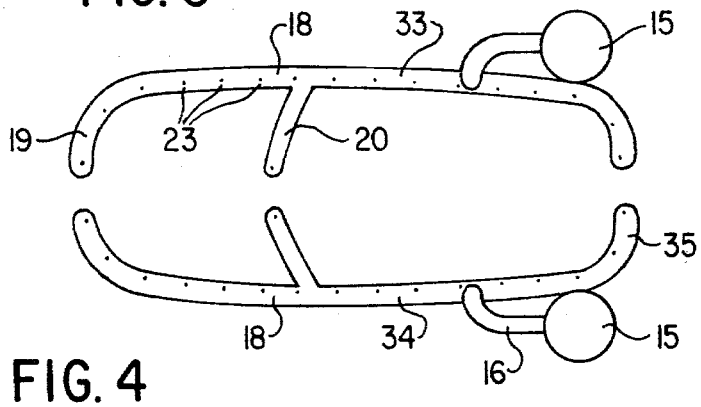
FIG. 4, is a schematic diagram of the air distribution system.
Figure 5:
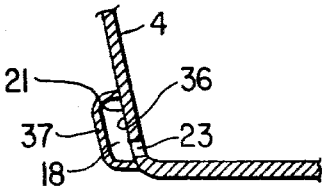
FIG. 5, is a sectional view in enlarged scale of a longitudinal air distribution duct.
Figure 6:
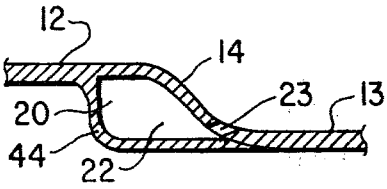
FIG. 6, is a cross-sectional view in enlarged scale of a branch of the air distribution system.
Figure 7:
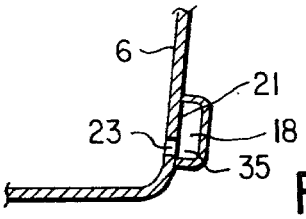
FIG. 7, is a cross-sectional view in enlarged scale of the air distribution duct adjacent the end wall.

Two air blowers 15 are secured below flat surface 7 adjacent one end of each of lateral surfaces 3 and 4, and the size and location of such blowers is such as to ensure that they properly fit within the vertical projection of flat surface 7 which is illustrated in FIG. 1 with two corners broken away for illustrative purposes. Each blower 15 feeds compressed air to an upwardly extending air supply pipe 16 connected to a downwardly extending duct 7 by means of a 180° coupling 32 located immediately below flat surface 7. Conduit 17 is connected to longitudinally extending air duct 18 which extends therefrom in two opposite directions toward end wall 6 and inclined wall 5. As best seen in FIG. 4 the air distribution system consists of two circuits 33 and 34 each having an air blower 15 connected via pipe 16, coupling 32 and vertical duct 17 to a longitudinally extending air duct 18 which terminates at 19 behind inclined wall 5, and at 35 behind end wall 6, with a central branch 20 running along ramp 14. When two blowers 15 are used circuits 33 and 34 need not be interconnected. FIG. 5 is a cross-section view of air duct 18 running along lateral wall 4. This duct is defined by the outer surface 36 of lateral wall 4 and by a U-shaped trough 37 secured to surface 36. Trough 37 may be preformed of glass fiber and secured in place with a suitable epoxy resin. As shown in FIG. 2 trough 37 is preferably a one-piece trough extending from coupling 32 and having its vertical component 40 leading to rear component 41 and to front component 42 at a T-shaped junction 43. The lowermost portion of air circuit 34 is branch defining trough section 44 and consequently this is the only region of the air distribution circuit where water could accumulate. FIG. 6 is a cross-section of trough section 44 below transverse ramp 14, taken through an aperture 23. By properly locating aperture 23 as close as possible to lower level 13 of floor 2, draining of duct 20 and the rest of both air distribution circuits 33, 34 is assured, especially when care is taken to ensure that the lowermost point in branch 20 is level with or slightly above the higher point of low level surface 13.

Small apertures 23 extending through the bathtub and leading into the air distrubution circuits 33, 34 direct air inwardly into the body of water (not shown) in the bathtub when blowers 15 are in use. As best illustrated in FIG. 1 series of evenly spaced apart apertures 23 are distributed around the bottom wall 2, there being at least two such apertures near the center of transverse ramp 14 and two more apertures at spaced apart locations in the shallow depression 11 of inclined wall 5. Preferably other apertures 23 will also be provided at the base of vertical end wall 6 for directing jets of air toward the feet of the user when in the reclined position with his back against inclined front wall 5.

By properly locating the air apertures 23 around the base of all four upstanding walls there is practically no possibility of obstruction of these orifices by the body of the user.

Moreover, by providing apertures 23 as low as possible in every section of air ducts 18 an effective and quick draining of all water from within the air distribution channels will take place simultaneously with draining of the bathtub 1. Complete drying of the air distribution system may be accomplished by allowing the air blowers 15 to operate for a short while after complete draining of the bathtub, and should a slight amount of water still remain entraped in the inwardly directed branches 20 on account of improper positioning of apertures 23 thereof a slight amount of suitable cleanser liquid poured into the adjacent area of bottom surface 2 will suffice to prevent water fouling. In practice however it is relatively easy to properly locate apertures 23 in such a manner as to prevent all possible accumulation of water in any region of the air distribution system 18.

As noted above, the air distribution system 18 comprises extensions 19 around the base of front inclined wall 5 leading to apertures 23 located at spaced apart locations in triangular depression 11. The jets of air thus produced insure proper massaging of the back and lower back regions of the user.

The above described hydromassaging tub may be easily mass produced from properly shaped shells made of glass fiber material. When the shell is constructed, a transversely extending support member 30 is secured to the lower surface of bottom wall 2 under higher level 12 in order to provide the desired degree of rigidity to the shell in that region, after which a preformed air distribution troughs 37 which may be made of plastic material or glass fiber material are secured in place on each lateral wall 3, 4 of the shell. Troughs 37 are properly secured by a suitable adhesive such as epoxy resin, and if necessary additional layers of glass fiber are applied thereover. The shell with the distribution system in place is then turned over to its normal standing position for drilling the various air distribution apertures 23 using a drill bit guiding jigg (not shown) to ensure drilling at the most favourable locations toward the base of the upstanding walls and into the lower portion of transversed ramp 14 for proper, unobstructed communication with the air distribution ducts 18 and branches 20.

In practice it has been found sufficient to provide about 12 apertures 23 along each lateral wall 3 and 4, two apertures at spaced apart locations in depression 11, two spaced apart apertures 23 in transversed ramp 14 and finally two more apertures at the base of vertical end wall 6. Additional apertures 23 may be provided in the rounded corners of the bathtub.

In a particularly successful embodiment in accordance with this invention each air blower 15 has a capacity of 110 cubic feet per minute feeding 17 apertures of even size being circular apertures measuring 3/16 of an inch in diameter.

As in conventional bathtubs the present hydromassage tub requires a suitable overflow drain (not shown) located about mid point between bottom surface 2 and horizontal surface 7. In order to prevent water from reaching the electric motors of blowers 15 via air ducts 18 and 17, the air supply to each air distribution channel 18 comprises a suitable snorkel defined by vertical air supply pipe 16, downwardly extending duct 17 and 180° coupling 32 located as high as possible and, as illustrated in FIG. 2, the 180° coupling 32 may be immediately below the lower surface of horizontal ledge 7.

The side surfaces of the hydromassage tub in accordance with this invention should be adequately covered with vertical panels (not shown) completely covering the air blowers 15 and the associated electrical wiring and air distribution system.

For adequate protection against electric shocks the electric motors of each blower 15 should be permanently connected to the building's source of electricity through a ground fault protection beaker.

As will be obvious to the man skilled in the art the present invention is not limited to the foregoing detailed description of a preferred embodiment of this invention and the scope of the present invention should be ascertained from the following claims.

I claim:

1. A hydromassaging apparatus comprising in combination a tub having a two-level bottom wall defined by two successive essentially flat surfaces interconnected to one another by a transverse ramp of limited extent, a front inclined wall having a shallow depression centrally thereof, an essentially vertically extending end wall and two lateral walls extending essentially vertically, compressed air supply means located adjacent said tub, longitudinally extending air distribution duct means secured to the outside surface of said tub peripherally thereof along the base of said front wall, end wall and lateral walls, said duct means also comprising air distribution branches disposed immediately adjacent said transverse ramp, and a plurality of small apertures extending through said tub from said air distribution ducts means, said apertures being evenly spaced apart along the base of said lateral walls there being at least two such apertures at spaced apart locations in said ramp, said air distribution duct means also comprising extensions behind the base of said front wall leading to apertures disposed at spaced apart locations of said shallow depression toward the base thereof.

2. Hydromassage tub as defined in claim 1 wherein said transverse ramp is located essentially at equal distance from said end wall and said front wall, and defines a smooth transition from the two levels of said bottom wall.

3. Hydromassage tub as defined in claim 1 wherein said duct means is defined by two laterally extending preformed troughs adequately secured to the outer surface of said tub adjacent the bottom of said lateral walls extending behind said front wall behind said end wall, each trough including a branch forming section secured to the lower surface of said transverse ramp and defining the lowermost portion of said duct means.

4. Apparatus as defined in claim 3 wherein the lowermost portion of said branch forming section is located at the level or slightly above the highest point of the lower level of said bottom wall, and comprises at least one said aperture essentially level with said lowermost portion of said branch forming section.

5. Apparatus as defined in any of claims 1, 3 or 4 wherein said compressed air supply means comprises a 180° coupling located immediately below the upper edge of said bathtub and interconnecting said air supply means to said duct means.

6. Apparatus as defined in claim 1 wherein said compressed air supply means comprises two electric motor driven air blowers permanently connected to a suitable supply of electricity through a ground fault protection breaker.

7. Apparatus as defined in claim 6 wherein each air blower has a capacity of approximately 100 cubic feet per minute.

8. Apparatus as defined in claim 1 or 7 comprising a total of approximately 34 apertures, each aperture being of circular cross-section measuring about 3/16 of an inch in diameter.

* * * * *